US005606124A

United States Patent [19]

Doyle et al.

[11] Patent Number: 5,606,124

[45] Date of Patent: Feb. 25, 1997

[54] APPARATUS AND METHOD FOR DETERMINING THE GRAVITATIONAL ORIENTATION OF A WELL LOGGING INSTRUMENT

[75] Inventors: Mark R. Doyle; David M. Chace; Dennis E. Roessler; John T. Evans; Paul A. Bergren, all of Houston, Tex.

[73] Assignee: Western Atlas International, Inc., Houston, Tex.

[21] Appl. No.: 655,304

[22] Filed: May 20, 1996

[51] Int. Cl.[6] ..... E21B 47/00

[52] U.S. Cl. ..... 73/152.01; 33/304

[58] Field of Search ..... 73/152.01; 33/304, 33/313

[56] References Cited

U.S. PATENT DOCUMENTS

| | | | |
|---|---|---|---|
| 3,597,598 | 8/1971 | McAllister | 364/453 |
| 4,265,028 | 5/1981 | Van Steenwyk | 33/304 |
| 4,297,790 | 11/1981 | Van Steenwyk | 33/313 |
| 4,433,491 | 2/1984 | Ott | 33/302 |
| 4,454,756 | 6/1984 | Sharp | 73/151 |
| 4,459,760 | 7/1984 | Watson | 340/853.8 |
| 4,461,088 | 7/1984 | Van Steenwyk | 33/304 |
| 4,468,863 | 9/1984 | Van Steenwyk | 33/304 |
| 4,471,533 | 9/1984 | Van Steenwyk | 33/302 |
| 4,559,713 | 12/1985 | Ott | 33/302 |
| 4,593,559 | 6/1986 | Brown | 73/151 |
| 4,611,405 | 9/1986 | Van Steenwyk | 33/304 |
| 4,706,388 | 11/1987 | Van Steenwyk | 33/304 |
| 4,768,152 | 8/1988 | Egli | 364/422 |
| 4,920,655 | 5/1990 | Van Steenwyk | 33/304 |
| 4,987,684 | 1/1991 | Andreas | 33/304 |
| 5,112,126 | 5/1992 | Graebner | 33/304 X |
| 5,331,578 | 7/1994 | Stieler | 33/313 X |

*Primary Examiner*—Hezron E. Williams
*Assistant Examiner*—Jay L. Politzer
*Attorney, Agent, or Firm*—Richard A. Fagin

[57] ABSTRACT

A method for determining orientation of an instrument with respect to earth's gravity. The method includes measuring components of earth's gravity along mutually orthogonal axes. One of the axes is substantially parallel to an axis of the instrument. Tilt of the instrument along two orthogonal axes is measured. One of the tilt axes is substantially parallel to the instrument axis. The instrument is rotated about its axis, and biases of the sensors used to measure the components of earth's gravity perpendicular to the instrument axis are calculated by averaging measurements made by these sensors during rotation. The ratio of gains of these sensors is determined from the range of amplitudes of the output of these sensors during rotation. A roll angle is determined from the bias corrected measurements of components of the earth's gravity perpendicular to the axis. The tilt measurement with respect to the two orthogonal axes is then calibrated by using the calculated roll angle. Gain and offset calibration of all the sensors used to measure the components of the earth's gravity is performed using the calibrated tilt measurements and the orientation is calculated from the gravity measurements after correction for gain and offset of the sensors.

14 Claims, 3 Drawing Sheets

APPARATUS AND METHOD FOR DETERMINING THE GRAVITATIONAL ORIENTATION OF A WELL LOGGING INSTRUMENT

BACKGROUND OF THE INVENTION

1. Field of the Invention

The invention is related to the field of directional surveying apparatus used in wellbores drilled through the earth. More specifically, the invention is related to apparatus and methods used to determine the orientation of a well logging instrument so that the measurements made by the instrument can be referenced with respect to a geographic benchmark.

2. Description of the Related Art

Well logging instruments include various types of sensors for measuring various properties of fluid flowing inside a wellbore. The measurements can be used for, among other things, determining the fractional volumes of different types of fluids flowing in the wellbore. The fluids can include mixtures having varying fractional volumes of gas, oil and water. Recently it has become common to drill wellbores at high angles of inclination with respect to vertical. The same types of sensors used to evaluate the fluids flowing in vertical wellbores have been adapted to determine the fractional volumes of fluids flowing in these high angle and horizontal wellbores. The adaptation of the sensors, however, typically requires that the measurements made by the adapted sensors be referenced to a benchmark such as the earth's gravity in order to be able to determine which portion of the cross-section of the wellbore is occupied by which type of fluid. Gravity is a convenient benchmark primarily because the fluids are typically segregated by gravity. It is useful, therefore, to include in such a well logging instrument a sensor which can determine the orientation of the well logging instrument with respect to gravity.

Sensors are known in the art for determining the relative orientation of a well logging instrument with respect to gravity and the earth's magnetic or geographic north pole. The sensors known in the art typically include three accelerometers positioned orthogonally to each other, and three magnetometers positioned mutually orthogonally (or alternatively, a gyroscope or similar geographic north-pole referencing device combined with a rotary orientation sensor). Combining the measurements of the accelerometers and magnetometers provides the system operator with the relative orientation of the instrument with respect to magnetic (or geographic) north and vertical (gravity).

Three orthogonal accelerometers alone could be adapted to provide a reference with respect to gravity suitable for the requirements of the fluid-flow sensor instrument previously described, but the accelerometers have several drawbacks which would make their use, without more, impracticable in such an instrument. For example, the accelerometers must be mounted in a very precisely machined fixture to assure that the sensitive axes of the accelerometers remain mutually orthogonal. The fixture with accelerometers included may require periodic calibration for orthogonality with respect to temperature since the well logging instrument may be subject to a wide range of ambient temperatures. The accelerometers themselves may require periodic calibration since the signal level, with respect to acceleration, that they generate is subject to change with time and with ambient temperature. Proper characterization of the response of the accelerometers may require a temperature sensor to be included with the instrument and the acceleration measurements to be corrected for temperature while a well log is being recorded. All of these methods of accelerometer calibration and characterization can be difficult and expensive to perform.

It is an object of the present invention to provide an inexpensive system for calibrating the orientation of a well logging instrument with respect to the earth's gravity that may be used while the instrument is disposed in the wellbore and does not require expensive and difficult periodic calibration to a benchmark standard.

SUMMARY OF THE INVENTION

The invention is a method for determining the orientation of an instrument with respect to the earth's gravity. The method includes the step of measuring components of the earth's gravity along mutually orthogonal axes. One of the mutually orthogonal axes is substantially parallel to an axis of the instrument. The tilt of the instrument along two orthogonal axes is measured. At least one of the axes of the tilt measurement is substantially parallel to the instrument axis. The instrument is then rotated about its axis, and the biases of the sensors used to measure the components of the earth's gravity, which are perpendicular to the instrument axis, are calculated by averaging the measurements made by these sensors during rotation. The ratio of gains of these same sensors is then determined from the peak amplitudes of the measurements from these sensors during the step of rotation. A roll angle is determined from the bias corrected measurements of components of the earth's gravity perpendicular to the instrument axis. The tilt measurements with respect to the two orthogonal axes are then calibrated by using the calculated roll angle. Gain and offset calibration of all the sensors used to measure the components of the earth's gravity is then performed using the calibrated tilt measurements, and the orientation of the instrument is then calculated from the gravity measurements after correction for gain and offset of the sensors.

An apparatus according to the invention includes three mutually orthogonal sensors each sensitive to the earth's gravity along a single sensitive axis. One of these axes is substantially parallel to the axis of the instrument. The apparatus includes a tilt sensor having two orthogonally sensitive axes, one of which is parallel to the instrument axis. The apparatus includes a processor for calculating the orientation of the instrument from the gravity and tilt measurements. In a preferred embodiment, the tilt sensor includes an electrolytic bubble level sensor, and the instrument includes a means for rotation so that the gains and offsets of the sensors can be determined.

DESCRIPTION OF THE PREFERRED EMBODIMENT

Figure 1:
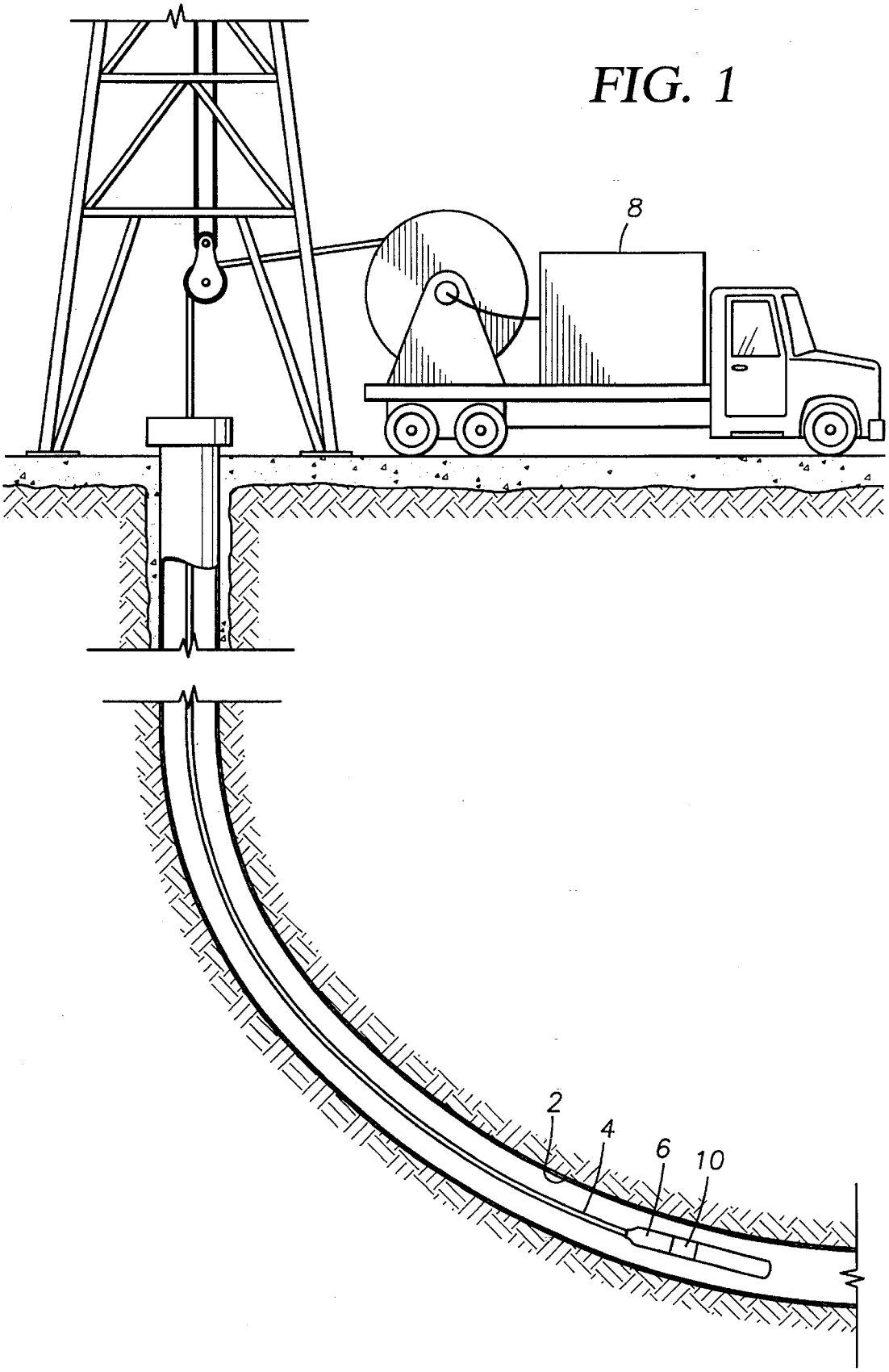
FIG. 1 shows a well logging instrument disposed in a wellbore drilled through the earth.

The orientation of a well logging instrument with respect to gravity can be determined by using various types of sensors which are sensitive to the earth's gravitational acceleration. FIG. 1 shows, in very generalized form, a well logging instrument 6 disposed in a wellbore 2 drilled through the earth. The instrument 6 can be lowered into the wellbore 2 and withdrawn from the wellbore 2 by an armored electrical cable 4. The instrument 6 typically includes a telemetry circuit (not shown) for communicating signals corresponding to measurements made by various sensors (not shown) on the instrument 6 to a surface electronics unit 8 where the signals can be decoded and interpreted.

The lowermost portion of the wellbore 2 in FIG. 1 is highly inclined with respect to vertical. In the highly inclined section of the wellbore 2, fluids (not shown) flowing in the wellbore may segregate due to gravity. It may be desirable to determine the nature and composition of the fluid flowing in the highly inclined section, which would typically require knowledge of the orientation of the sensors with respect to the earth's gravity.

Other types of logging instruments may include sensors (not shown) which make measurements of rock properties at a plurality of locations each along only a small portion of the circumference of the wellbore 2. It is equally desirable to be able to determine the gravimetric orientation of such circumferential sensors (not shown).

To determine the orientation of the instrument 6 with respect to gravity, the instrument 6 in FIG. 1 includes an orientation sensor 10. The measurements made by the orientation sensor 10 can be transmitted to the surface electronics 8, or may alternatively be processed and stored in the instrument 6.

Figure 2:
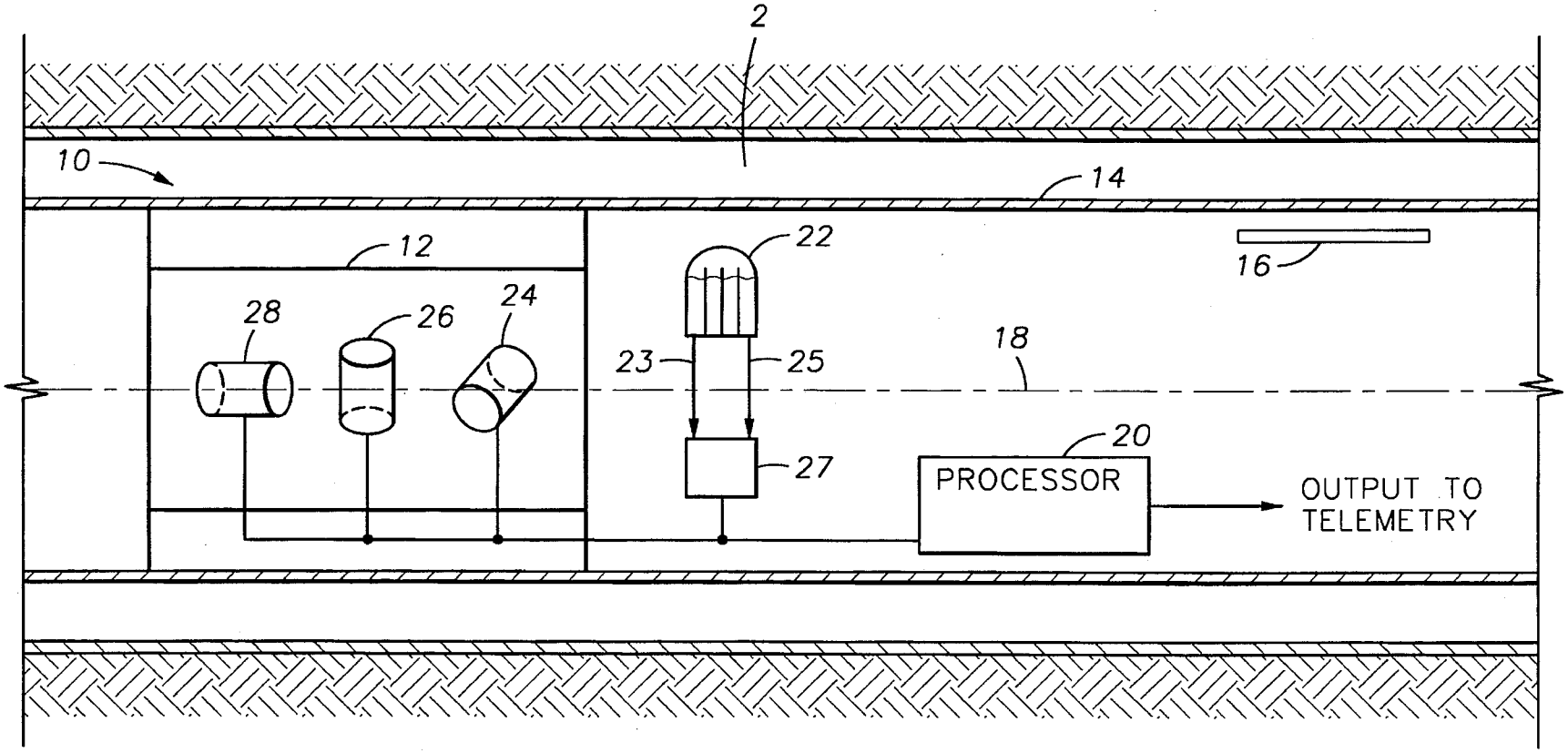
FIG. 2 shows in detail the sensors used in the well logging instrument to determine the orientation of the instrument with respect to gravity.

The orientation sensor 10 is shown in more detail in FIG. 2. The sensor 10 is disposed within a housing 14. The housing 14 typically has a reference indicator 16, to which all the measurements made by the other sensors (not shown) would be directionally referenced. Inside the housing 14 is a frame 12 on which can be mounted three accelerometers shown at 24, 26 and 28. Accelerometer 28 is typically mounted on the frame 12 so as to have its sensitive axis substantially parallel with the axis 18 of the housing 14. As will be further explained, accelerometer 28 can be defined as measuring the Z axis component of the earth's gravity. Accelerometer 26 is typically mounted in the frame 12 so as to have its sensitive axis disposed along a line substantially perpendicular to the housing axis 18, and extending between the housing axis 18 and the reference indicator 16. As will be further explained, accelerometer 26 can be defined as measuring the X axis gravity component. Accelerometer 24 can be mounted in the frame 12 orthogonal to both accelerometers 24 and 26, and can be defined as measuring the Y gravity component. The accelerometers 24, 26, 28 can be electrically connected to a processor 20 which determines the output of each accelerometer 24, 26, 28 for processing as will be further explained. The accelerometers 24, 26, 28 can be any type known in the art for accurately measuring acceleration on the order of 1 g, for example, one made by Analog Devices, Inc., Norwood, Mass. sold under model designation ADXL05. Processing the output of the accelerometers 24, 26, 28 into measurements of acceleration is well known in the art.

The orientation sensor 10 can include a two-axis tilt sensor 22 disposed within the housing 14 and mounted so that its sensitive axes are substantially parallel to the sensitive axes of accelerometers 26 and 24, the X and Y gravity components, respectively. The tilt sensor 22 can be an electrolytic bubble level type such as one made by Spectron, Inc., Hauppage N.Y. sold under model designation SP500. Methods of processing the output of the tilt sensor 22 into tilt angles relative to gravity are well known in the art. The two outputs 23, 25 of the tilt sensor 22, in the present embodiment however, are preferably coupled to the processor 20 by means of a multiplexer switch 27, so that the same amplifying and signal conditioning circuits (not shown) in the processor 20 will be applied to both outputs 23, 25 of the tilt sensor 22, so as to eliminate variability in gain and offset of such circuits (not shown) from the signal processing, as will be further explained.

The components of the apparatus of the invention having been explained, the method of processing the signals of the accelerometers 24, 26, 28 and the tilt sensor 22 into calibrated orientation of the orientation sensor 10 will now be explained.

Figure 3:
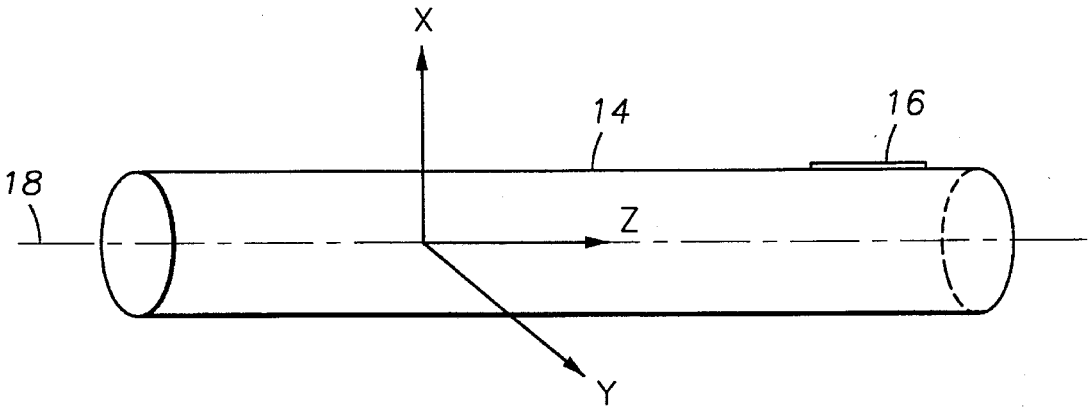
FIG. 3 shows a coordinate system definition with respect to the well logging instrument for explanation of the principle of the invention.

FIG. 3 shows the coordinate system defined for the instrument (6 in FIG. 2) in more detail. As a matter of convenience, the X axis, as previously explained, is defined as being along a line generally perpendicular to the housing axis 18 and passing between the reference indicator 16 on the housing 14 and the housing axis 18. Rotation of the instrument 6 about the X axis can be defined for convenience as "yaw". The Y axis is generally perpendicular both to the X axis and to the housing axis 18. Rotation of the instrument 6 about the Y axis for convenience can be defined as "pitch". The Z axis, as previously explained, can be substantially parallel to the housing axis 18. Rotation of the instrument 6 about the Z axis can be defined for convenience as "roll".

Figure 4:
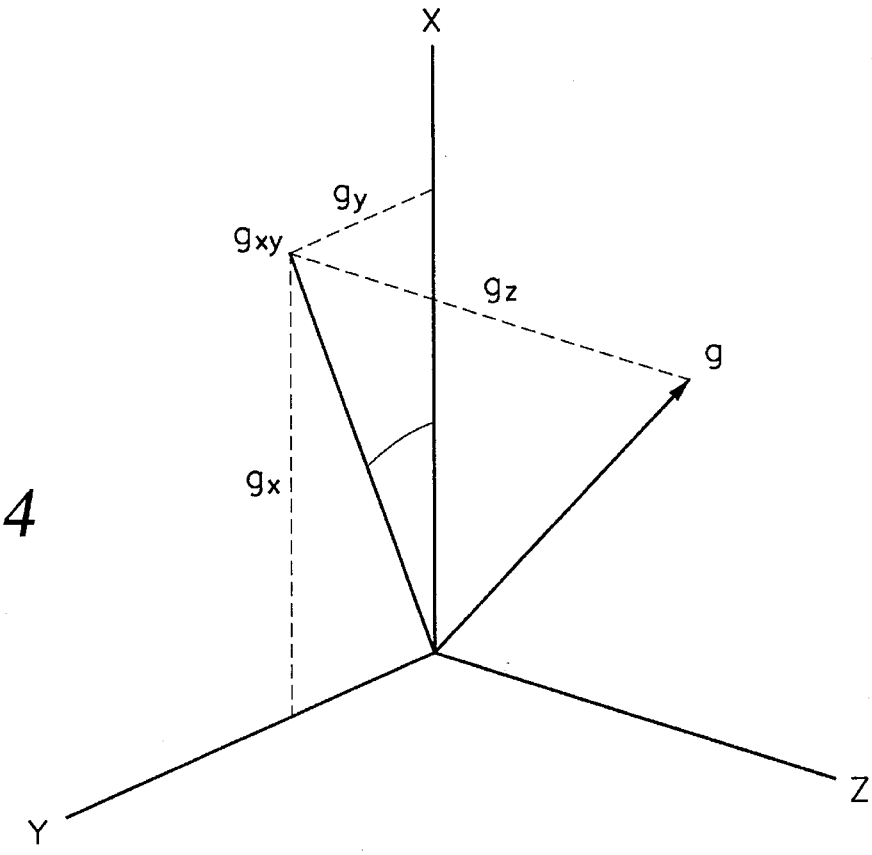
FIG. 4 graphically shows the resultant of fractional components of the earth's gravitational vector impressed on the individual sensors in the well logging instrument.

The accelerometers (24, 26, 28 in FIG. 2) each provide a signal output which corresponds to the net acceleration along the sensitive axis of each accelerometer 24, 26, 28. For example, if the instrument 6 were disposed in a vertical wellbore, all of the earth's gravity would act on the sensitive axis of the Z axis accelerometer 28, and substantially none of the earth's gravity would act on the sensitive axes of the X and Y axis accelerometers, 26 and 24, respectively. If the instrument is oriented other than vertically along the housing axis 18, a proportional amount of the earth's gravity acting on each accelerometer 24, 26, 28 can be described as the relative projection of the earth's gravity vector onto the sensitive axis of each accelerometer 24, 26, 28. This principle can be better understood by referring to FIG. 4. If the direction of the earth's gravitational vector were known, the total gravitational vector, g, could be expressed as:

$$g=g_x i_x+g_y i_y+g_z i_z \tag{1}$$

for unit vectors $i_x$, $i_y$ and $i_z$ along the X, Y and Z axes, respectively, and projected components $g_x$, $g_y$, and $g_z$, respectively. The earth's gravitational vector, g, is considered to be of nominally constant magnitude defined as 1 "g" of acceleration so that:

$$\|g\|=\sqrt{g_x^2+g_y^2+g_z^2}=1 \tag{2}$$

An angle subtended by motion about the housing axis 18 as the previously described "roll" can then be defined as the angle between the projection of g onto the X-Y plane and defined by the following expression:

$$\theta_{roll}=atan2(g_y, g_x) \tag{3}$$

where $atan2(g_y, g_x)$ represents the four-quadrant inverse tangent function of $g/g_x$. When the reference indicator (16 in FIG. 2) is positioned so that a line between it and the axis 18 is vertical, $\theta_{roll}$ is equal to zero. Similar expressions can be derived for the pitch and the yaw angles as shown here:

$$\theta_{pitch}=\text{atan2}(g_z, g_x) \quad (4)$$

$$\theta_{yaw}=\text{atan2}(g_y, g_z) \quad (5)$$

As will be further explained, the expressions for pitch, roll and yaw angles will be used in the method of the invention to calibrate the outputs of the accelerometers 24, 26, 28 and the tilt sensor 22 so that the true orientation of the instrument 6 with respect to the earth's gravity can be determined.

Accelerometer calibration is needed to properly scale the signals generated by each accelerometer 24, 26, 28 into a magnitude of the projected component of the earth's gravity vector which is coaxial with the sensitive axis of each accelerometer 24, 26, 28. An accelerometer such as 24, 26 and 28 typically generates a signal which corresponds in magnitude to the acceleration along its sensitive axis. This correspondence can be substantially linear, but a constant of proportionality (called the gain), and a bias error at zero net acceleration (called the offset) may not be precisely known, and must therefore be determined, or "calibrated". The magnitude of the accelerometer signal,v, in response to an applied acceleration, $\gamma$, can be expressed as:

$$v=k\gamma+c \quad (6)$$

where k represents the gain and c represents the offset. For the accelerometer system shown in FIG. 2, the earth's gravity projection components $g_x$, $g_y$, $g_z$ acting respectively on each accelerometer 26, 24, 28, can be expressed in terms of each accelerometer's signal output $a_x$, $a_y$, $a_z$ by the expressions:

$$a_x=k_xg_x+c_x \quad (7)$$

$$a_y=k_yg_y+c_y \quad (8)$$

$$a_z=k_zg_z+c_z \quad (9)$$

As previously described, the tilt sensor (22 in FIG. 2) is oriented to provide measurements corresponding to the pitch angle and to the roll angle. Just as with the accelerometers 24, 26, 28, the correspondence between the true pitch angle, $\theta_{pitch}$, and the true roll angle, $\theta_{roll}$, and the respective signals generated by the tilt sensor 22, $\phi_{pitch}$ and $\theta_{roll}$, can be described in terms of a proportionality constant k and a bias error c (gain and offset, respectively) as shown in the following expressions:

$$\phi_{pitch}=k_{pitch}\theta_{pitch}+c_{pitch} \quad (10)$$

$$\phi_{roll}=k_{roll}\theta_{roll}+c_{roll} \quad (11)$$

First, the invention calibrates the X and Y axis accelerometers by rotating the orientation sensor (10 in FIG. 1 ) about the instrument axis 18. This rotation can be performed at the earth's surface while the instrument (6 in FIG. 1 ) is positioned in an appropriate calibration fixture, but preferably the rotation can be performed while the instrument (6 in FIG. 1) is disposed in the wellbore (2 in FIG. 1) by means of a motor and axial pivot assembly (not shown for clarity of the illustrations) to which the housing (14 in FIG. 2) may be attached. Performing the rotation while the instrument 6 is in the wellbore 2 provides that the calibration will also account for any effect of ambient temperature on the accelerometers 24, 26, 28 and the tilt sensor 22 without further characterization. The actual manner of rotating the orientation sensor 10 is not important to the invention, and so is not to be construed as a limitation on the invention.

If the orientation sensor 10 is rotated about the Z axis when it is not oriented vertically (when the housing axis 18 is parallel to the earth's gravity vector), then an alternative expression for the earth's gravitational vector can be shown in the following equation:

$$g=g_{xy}i_{xy}+g_zi_z \quad (12)$$

where the unit vector $i_{xy}$ lies wholly within the X-Y plane, and $g_{zy}$ represents the projection of the gravitational vector onto the X-Y plane. While the orientation sensor 10 is rotated about the Z axis (the housing axis 18), the projection of the rotating vector $g_{xy}i_{xy}$ onto either the X axis or the Y axis can be represented by a sinusoid having an amplitude $g_{xy}$. As can be inferred from equation (12), the instrument is preferably oriented as closely to horizontal (housing axis 18 being perpendicular to the earth's gravitational vector) as is practical in order to maximize the amplitude of this sinusoid, although the described procedure will work at other non-vertical orientation angles. The accelerometers 26, 24, 28 will then measure:

$$a_x=k_xg_{xy}\cos(\omega t+\alpha)+c_x \quad (13)$$

$$a_y=k_yg_{xy}\sin(\omega t+\alpha)+c_y \quad (14)$$

$$a_z=k_zg_z+c_z \quad (15)$$

where $\omega$ represents the rotation rate, t represents time, $\alpha$ represents a constant which depends on the initial rotary orientation (roll angle) of the orientation sensor 10 with respect to gravity, and the quantity $\omega t+\alpha$ represents the previously described roll angle, $\omega_{roll}$. The rotation rate should preferably be kept low enough so that the accelerometers can properly respond to the change in acceleration. Typical accelerometers, such as the ones described, can have a useful response at frequencies up to and exceeding 100 Hz, so it is contemplated that rotation rates of 0.1 to 1.0 revolution per second will generally not exceed the useful measurement range of the accelerometers 24, 26, 28. As can be inferred from equations (13) and (14), the bias errors $c_x$, $c_y$, respectively, in the X and Y axis accelerometers can be determined as the mean value of the corresponding signal sinusoids generated by rotating the orientation sensor 10. The sinusoids will have true amplitude $g_{xy}$, so the peak amplitude range (maximum less minimum) actually measured by the X axis and Y axis accelerometers corresponds, respectively, to the products [2 $k_xg_{xy}$] and [2 $k_{xy}$]. Rotating the orientation sensor 10, therefore, allows determination of the individual X and Y axis offsets and the relative gain between the X and Y axis measurements, or the "gain ratio" $k_y/k_x$. These values and the results of equations (13) and (14) enable the determination of the true roll angle, $\theta_{roll}$, by the following expression:

$$\theta_{roll}=a\tan2\left(\frac{a_y-c_y}{k_yg_{xy}}, \frac{a_x-c_x}{k_xg_{xy}}\right) \quad (16)$$

To evaluate equation (16) it is not necessary to determine $g_{xy}$ because only the ratio of operands is important.

Having determined the true roll angle from the acceleration measurements as shown in equation (16), it is then possible to directly calibrate the gain ($k_{roll}$) and the offset ($c_{roll}$) of the tilt sensor (22 in FIG. 2).

The tilt sensor 22 is a single physical device. The two outputs of the tilt sensor 22 can be multiplexed to a single processing circuit (not shown) in the processor (20 in FIG. 2). It can therefore be reasonably assumed that the "pitch" gain and offset are the same, respectively, as the "roll" gain and offset for the tilt sensor 22, which were calibrated as previously described. Therefore:

$$k_{pitch}=k_{roll} \quad (17)$$

$$C_{pitch}=c_{roll} \quad (18)$$

It should be noted that the method of calibrating the tilt sensor 22 described herein is not limited to determination of gain and offset constants. Should the correspondence between the true pitch and roll angles, and the outputs of the tilt sensor 22 be related by higher order polynomials, for example, the coefficients of such polynomials may be readily determined by linear regression.

Having calibrated the gain and offset of the tilt sensor 22, it is then possible to determine the gain and offset of all three accelerometers 24, 26, 28 by using the calibrated pitch and roll measurements from the tilt sensor 22. First, the actual projection components of the earth's gravitational vector are calculated by the following expressions:

$$g_y=g_x\tan(\theta_{roll}) \quad (19)$$

$$g_z=g_x\tan(\theta_{pitch}) \quad (20)$$

$$g_x=\sqrt{1-g_y^2-g_z^2}=(1+\tan^2(\theta_{roll})+\tan^2(\theta_{pitch}))^{-1/2} \quad (21)$$

Then the gains and offsets of the three accelerometers 24, 26, 28 can be resolved by comparing the calculated projection components to the measured accelerations. The Z axis accelerometer 28 is preferably calibrated by moving the instrument 6 through the wellbore 2 and comparing the pitch angles measured by the tilt sensor 22 with the accelerations measured by the Z axis accelerometer 28. Natural variations in the pitch angle of the instrument 6 should provide enough basis for comparison to perform the calibration. A linear regression can be performed on the comparisons between the Z axis accelerometer 28 measurements and the pitch angles measured by the tilt sensor 22 to calibrate the gain and offset of the Z axis accelerometer 28. It is contemplated that the Z axis accelerometer 28 could also be calibrated at the earth's surface by suspending the instrument substantially motionless, making one set of acceleration and pitch measurements, manually changing the instrument pitch several degrees and then again measuring pitch and Z axis acceleration to perform a two-point calibration. The precision of the two-point calibration of the Z axis accelerometer would typically be lower than the linear regression calibration performed while the instrument 6 is moved through the wellbore 2, but this could be improved by measuring at a plurality of different points and performing a linear regression analysis.

It is possible, using the roll angle measurement made as described herein, to operate a motor control system (not shown) for orienting the housing 14 to any rotary orientation with respect to earth's gravity desired by the system operator. Such control systems are known in the art.

The embodiment of the invention described herein is meant to serve only as an example and is not meant to limit the invention. Those skilled in the art will readily devise other embodiments which do not depart from the spirit of the invention. Accordingly, the invention should be limited in scope only by the attached claims.

What is claimed is:

1. An apparatus for determining the gravimetric orientation of an instrument, comprising:

gravity sensors responsive to components of the earth's gravity along mutually orthogonal axes, one of said axes substantially parallel to an axis of said instrument;

a tilt sensor responsive to two orthogonal angles of tilt, one of said orthogonal angles referenced to a line substantially parallel to said axis of said instrument, wherein outputs of said tilt sensor are multiplexed into a single signal processing channel; and a processor, operatively connected to said gravity sensors and said tilt sensor, said processor including means for calculating relative gains and bias errors of said gravity sensors from a peak-to-peak amplitude of signals from said gravity sensors obtained through rotation of said instrument about said axis, said processor including means for calibrating said tilt sensor from said relative gains and bias errors of said gravity sensors, said processor including means for calculating absolute gains of said gravity sensors from calibrated signals from said tilt sensor said processor including means for calculating an orientation of said instrument from signals generated by said gravity sensors calibrated for said bias and said absolute gain.

2. The apparatus as defined in claim 1 wherein said gravity sensors comprise three mutually orthogonal accelerometers.

3. The apparatus as defined in claim 1 wherein said tilt sensor comprises an electrolytic bubble level sensor.

4. The apparatus as defined in claim 1 wherein outputs of said tilt sensor are multiplexed into a single signal processing channel.

5. The apparatus as defined in claim 1 further comprising means for rotating said instrument about said axis of said instrument.

6. The apparatus as defined in claim 5 further comprising means for selectively controlling said orientation of said instrument in response to determination of a direction of the earth's gravity.

7. A method for determining the orientation of an instrument with respect to gravity, comprising:

measuring components of said gravity along mutually orthogonal axes, one of said axes substantially parallel to an axis of said instrument;

measuring output of a tilt sensor disposed in said instrument along two orthogonal axes, one of said tilt axes substantially parallel to said instrument axis;

rotating said instrument about said instrument axis;

calculating a roll angle from said measurements of said components of said gravity perpendicular to said instrument axis, said step of calculating said roll angle comprising calculating biases of sensors used to measure said components of said gravity perpendicular to said instrument axis by averaging measurements made by said sensors during said rotating, said step of calculating said roll angle comprising calculating a ratio of gains of said sensors from peak amplitudes of said measurements made during said rotating;

calibrating said output of said tilt sensor perpendicular to said instrument axis by characterizing said output with respect to said roll angle;

calibrating said output of said tilt sensor perpendicular to said axis by multiplexing said outputs from said tilt sensor along and perpendicular to said axis into a signal processing unit, whereby said outputs of said tilt sensor along and parallel to said axis are assumed to be calibrated by substantially identical gain and offset calibration constants;

calibrating gain and offset of all of said sensors used to measure said components of said gravity by scaling said measurements of gravity previously corrected for bias of said sensors with respect to said calibrated tilt sensor outputs; and calculating said orientation from said gravity measurements after correction for gain and offset of said gravity sensors.

8. The method as defined in claim 7 further comprising selectively controlling said orientation of said instrument about said instrument axis in response to determination of a direction of said gravity with respect to said instrument.

9. An apparatus for determining the gravimetric orientation of an instrument, comprising:

gravity sensors responsive to components of the earth's gravity along mutually orthogonal axes, one of said axes substantially parallel to an axis of said instrument;

a gravity-referenced tilt sensor responsive to two orthogonal angles of tilt, one of said orthogonal angles referenced to a line substantially parallel to said axis of said instrument; and a processor, operatively connected to said gravity sensors and said tilt sensor, said processor including means for calibrating signals generated by said gravity sensors and said tilt sensor, said processor including means for calculating an orientation of said instrument from said calibrated signals generated by said sensors and said gravity-referenced tilt sensor.

10. The apparatus as defined in claim 9 wherein said gravity sensors comprise three mutually orthogonal accelerometers.

11. The apparatus as defined in claim 9 wherein said gravity-referenced tilt sensor comprises an electrolytic bubble level sensor.

12. The apparatus as defined in claim 9 wherein outputs of said tilt sensor are multiplexed into a single signal processing channel.

13. The apparatus as defined in claim 9 further comprising means for rotating said instrument about said axis of said instrument.

14. The apparatus as defined in claim 13 further comprising means for selectively controlling said orientation of said instrument in response to determination of a direction of the earth's gravity.

* * * * *